US010457531B2

(12) United States Patent
Zheng

(10) Patent No.: US 10,457,531 B2
(45) Date of Patent: Oct. 29, 2019

(54) WINCH AND SAFETY DEVICE THEREOF

(71) Applicant: NINGBO CHIMA WINCH CO., LTD., Ningbo (CN)

(72) Inventor: Mingkui Zheng, Ningbo (CN)

(73) Assignee: NINGBO CHINA WINCH CO., LTD., Ningbo (CN)

( * ) Notice: Subject to any disclaimer, the term of this patent is extended or adjusted under 35 U.S.C. 154(b) by 158 days.

(21) Appl. No.: 15/663,845

(22) Filed: Jul. 31, 2017

(65) Prior Publication Data

US 2018/0148306 A1 May 31, 2018

(30) Foreign Application Priority Data

Nov. 30, 2016 (CN) ..... 2016 2 1304003 U
Nov. 30, 2016 (CN) ..... 2016 2 1304091 U
Jan. 19, 2017 (CN) ..... 2017 1 0039458

(51) Int. Cl.

| | |
|---|---|
| ***B66D 1/58*** | (2006.01) |
| ***G08B 21/02*** | (2006.01) |
| ***G08B 29/18*** | (2006.01) |
| ***G08B 21/18*** | (2006.01) |
| ***G08B 5/22*** | (2006.01) |
| ***B66D 1/00*** | (2006.01) |
| ***B66D 1/12*** | (2006.01) |
| ***B66D 1/46*** | (2006.01) |
| *G09G 3/10* | (2006.01) |

(52) U.S. Cl.

CPC ..... *B66D 1/58* (2013.01); *B66D 1/00* (2013.01); *B66D 1/12* (2013.01); *B66D 1/46* (2013.01); *G08B 5/22* (2013.01); *G08B 21/02* (2013.01); *G08B 21/182* (2013.01); *G08B 29/181* (2013.01); *B66D 2700/0141* (2013.01); *G09G 3/10* (2013.01); *G09G 2330/021* (2013.01)

(58) Field of Classification Search

CPC .... B66D 1/58; B66D 1/46; B66D 2700/0141; G08B 5/22; G09G 2330/021

See application file for complete search history.

(56) References Cited

U.S. PATENT DOCUMENTS 3,269,562 A * 8/1966 Holmes ..... B65G 67/00 212/286
5,441,127 A * 8/1995 Ikejima ..... B66B 1/28 181/292

(Continued)

*Primary Examiner* — Emmanuel M Marcelo
(74) *Attorney, Agent, or Firm* — Gokalp Bayramoglu

(57) ABSTRACT

The invention provides a safety device for a winch, which would not startle or otherwise easily impact the psychology of a user, so that the user can use the winch more safely. The safety device of a winch includes a power module, a detection module and a control module, and further includes a display driving module and a display module. The display driving module is electrically connected to the display module. The display driving module and the detection module are electrically connected to the power module. The power module, the detection module and the display driving module are electrically connected to the control module. The invention further provides a winch, further including a detection device and an expression device. The detection device is used for detecting the working load of a motor. The expression device is used for expressing the load according to the detection signal of the detection device.

6 Claims, 7 Drawing Sheets

(56) References Cited

U.S. PATENT DOCUMENTS

| | | | | |
|---|---|---|---|---|
| 5,859,373 | A * | 1/1999 | Munzebrock | B66C 13/16 73/862.193 |
| 2007/0205405 | A1* | 9/2007 | Stockmaster | B66D 3/18 254/275 |
| 2009/0223434 | A1* | 9/2009 | Zorn | B66B 3/026 116/226 |
| 2012/0160796 | A1* | 6/2012 | Weckbecker | B66C 13/28 212/284 |
| 2013/0253759 | A1* | 9/2013 | Matsumoto | B66C 23/905 701/31.1 |
| 2016/0257534 | A1* | 9/2016 | Kawai | B66C 13/50 |

* cited by examiner

WINCH AND SAFETY DEVICE THEREOF

CROSS REFERENCE TO RELATED APPLICATIONS

This application is based upon and claims priority to Chinese Patent Application No. 201621304091.9, filed on Nov. 30, 2016, the Chinese Patent Application No. 201621304003.5, filed on Nov. 30, 2016, and the Chinese Patent Application No. 201710039458.1, filed on Jan. 19, 2017, the entire contents of which are incorporated herein by reference.

TECHNICAL FIELD

The invention relates to the field of winch safety technology, particularly to a winch and safety device thereof.

BACKGROUND OF THE INVENTION

The existing safety design for a winch mainly uses overload detection. For example, safety is achieved through overload alarms. Even though the safety of using the winch is improved to a certain extent, the alarm prompt is given only when an overload happens. The problems of the existing alarm device are provided as below. On the one hand, the alarm occurs suddenly, and a user is not psychologically prepared, and therefore a sudden alarm can easily cause a certain impact to the psychology of the user, so that the alarm causes a certain discomfort by startling the user. Especially for a novice, the alarm and accompanying fright and shock can even cause the user to feel disoriented after the alarm is received, so that the user may cause a safety accident due to disorientation. On the other hand, the change in load during operation is not readily apparent to the user, and therefore, the user has no way to proactively control the winch. Lack of proactive initiative results in a decreased safety in operation of the winch.

SUMMARY OF THE INVENTION

The technical problems to be solved by the invention are to overcome the defects in the prior art, and provide a winch and a safety device thereof, which do not startle or otherwise easily impact the psychology of a user, so that the user can use the winch more safely.

The safety device of a winch includes a power module, a detection module and a control module, and further includes a display driving module and a display module. The display driving module is electrically connected to the display module. The display driving module and the detection module are respectively electrically connected to the power module. The power module, the detection module and the display driving module are respectively electrically connected to the control module. The control module is used for converting the signals detected by the detection module into control signals, which are used to control the display driving module to drive the display module to display.

In view of the above-mentioned structures, compared with the prior art, the present invention has the following advantages. The detection module is used for detecting the change of the load carried by the winch. According to the signals detected by the detection module, the control module controls the display driving module to drive the display module to display a load value or a pull force value, so that a user can know the condition of the load or any change of the pull force. The user makes a decision according to the displayed information on the display module. When an overload is almost reached, the user can make a decision in advance to avoid the overload. The whole operation process of the winch is monitored by the user, and thus it would not easily impact on the psychology of the user, and the user can use the winch more safely.

As an improvement, the safety device further includes an alarm module, and the power module and the control module are respectively electrically connected to the alarm module. In this way, an alarm may still be given in case of an overload, so that the functions of the present invention, including reminding the user, are more complete.

As an improvement, the power module includes a voltage boosting unit, a first voltage reducing and stabilizing unit, and a second voltage reducing and stabilizing unit. The first voltage reducing and stabilizing unit and the second voltage reducing and stabilizing unit are respectively electrically connected to the voltage boosting unit. The first voltage reducing and stabilizing unit is electrically connected to the display driving module. The detection module and the control module are respectively electrically connected to the second voltage reducing and stabilizing unit. The purposes of the design are provided as below. When the winch is in use, there are fluctuations and influences brought by a voltage drop of the power supply. The boosting unit can guarantee the normal operation of the post-stage circuit, namely, the normal operation can be performed during a period of pressure drop or in case of a pressure drop fluctuation. This is important for the surroundings where the winch is used, because the power of a winch is generally supplied by a storage battery. The present invention works with a winch, and is also powered by the storage battery. In general, the winch would not cause a high voltage drop of the storage battery. However, based on the self-differences of the storage batteries and the working complexities (due to factors such as different loads of the winch, different continuous working periods of the winch, and temperature changes of the surroundings), pressure drops may randomly occur. In case of a pressure drop, there are hidden safety concerns if the present invention cannot work normally. The above-mentioned design may guarantee the normal running of the winch in the whole process of using the winch, so that the safety of the winch can be stable and reliable.

As an improvement, the first voltage reducing and stabilizing unit, the display driving module, and the display module are all arranged at the control handle of the winch. The purposes of the design are provided as below. The control handle of the winch is generally electrically connected to the winch through a cable. If the cable is longer, then the cable would cause a voltage drop. If the first voltage reducing and stabilizing unit is used, a higher voltage may be provided for a power supply and the higher voltage is then reduced by the first voltage reducing and stabilizing unit for later use. In this way, a problem of the pressure drop caused by the cable is solved, so that normal operations of the first voltage reducing and stabilizing unit, the display driving module and the display module can be guaranteed.

As an improvement, the safety device further includes an adjusting module, which is used for setting an alarm threshold value of the control module, so that the present invention may be flexibly adapted to the winch with different powers, and the production cost of a whole set of winches may thus be reduced.

As an improvement, the control module is provided with a switching unit, which is used for the control module to selectively switch between two states. The purposes of the design are provided as below. The winch may be roughly divided into a winch with a low power and a winch with a high power. The signals detected by the detection module under the conditions of the low power and the high power are greatly different. The operations in the control module may be selected according to the conditions of the low power and the high power through the switching unit, so that the more accurate load value or pull force value may be displayed. It is unnecessary to change the other components of the present invention, and thus for the present invention, the flexibility of adapting to the winch is remarkably improved and the manufacturing cost of the present invention is reduced.

The present invention provides a winch, including a motor, a winch drum, and a bracket. The motor and the winch drum are both connected to the bracket. The motor is used for driving the winch drum to rotate. The winch further includes a detection device and an expression device. The detection device is used for detecting the working load of the motor. The expression device is used for expressing the load according to the detection signal of the detection device.

In view of the above-mentioned structures, compared with the prior art, the present invention has the following advantages. The detection device is used for detecting the load change of the winch, and the expression device is used for expressing the load according to the detection signal of the detection device, so that the user may know the condition of the load or the change of the pull force. The user makes a decision according to the information of the expression device. When an overload is almost reached, the user can make a decision in advance to avoid the overload. The whole operation process of the winch is monitored by the user, and thus it would not easily impact on the psychology of the user or suddenly startle the user, and the user can use the winch more safely.

As an improvement, the winch further includes a power module, and the expression device includes a control module, a display driving module and a display module. The display driving module is electrically connected to the display module. The display driving module and the detection device are respectively electrically connected to the power module. The power module, the detection device, and the display driving module are respectively electrically connected to the control module. The control module is used for converting the signals detected by the detection module into control signals, which are used to control the display driving module to drive the display module to display.

In this way, the above-mentioned structures are aimed to convert the analog signals detected by the detection device into digital signals, which are used for controlling and displaying. Namely, the load is expressed in a more accurate manner, such as a pulling force. Specifically, according to the detecting signals detected by the detection device, the control module controls the display driving module to drive the display module to display a load value or a tension value, so that the user can understand the condition of the load or the change of the pull force more simply and easily. Hence, the user can use the winch more safely.

As an improvement, the expression device includes a first circuit board and a second circuit board, the first circuit board is arranged in a control box of the winch, and the second circuit board is arranged at the control handle of the winch. The first circuit board is provided with a voltage boosting unit, a second voltage reducing and stabilizing unit, and a control module. The second circuit board is provided with a first voltage reducing and stabilizing unit, a display driving module, and a display module. In this way, the structures are more reasonable to facilitate production and assembly.

Wherein the following reference designators correspond to the following structures, 1. motor, 2. winch drum, 3. bracket, 4. control box, 5. control handle, 6. power supply wire, 7. hall current sensor, 8. first circuit board, 9. display module, 10. contactor, and 11. connector.

DETAILED DESCRIPTION OF THE INVENTION

The present invention is further described in detail as below.

Embodiment 1

The safety device of a winch includes a power module, a detection module and a control module, and further includes a display driving module and display module 9. The display driving module is electrically connected to the display module 9. The display driving module and the detection module are respectively electrically connected to the power module. The power module, the detection module and the display driving module are respectively electrically connected to the control module. The control module is used for converting the signals detected by the detection module into control signals, which are used to control the display driving module to drive display module 9 to display.

The safety device further includes an alarm module, and the power module and the control module are respectively electrically connected to the alarm module.

The power module includes a voltage boosting unit, a first voltage reducing and stabilizing unit, and a second voltage reducing and stabilizing unit. The first voltage reducing and stabilizing unit, and the second voltage reducing and stabilizing unit are respectively electrically connected to the voltage boosting unit. The first voltage reducing and stabilizing unit is electrically connected to the display driving module. The detection module, and the control module are respectively electrically connected to the second voltage reducing and stabilizing unit.

The first voltage reducing and stabilizing unit, the display driving module, and display module 9 are all arranged at control handle 5 of the winch.

The safety device further includes an adjusting module, which is used for setting an alarm threshold value of the control module.

The control module is provided with a switching unit, which is used for the control module to selectively switch between two states.

In this embodiment, the safety device of the winch of the present invention can be roughly divided into two parts, namely a first part and a second part. The first part is configured to be arranged on the winch, and the second part is configured to be arranged at a control handle of the winch.

Figure 1:
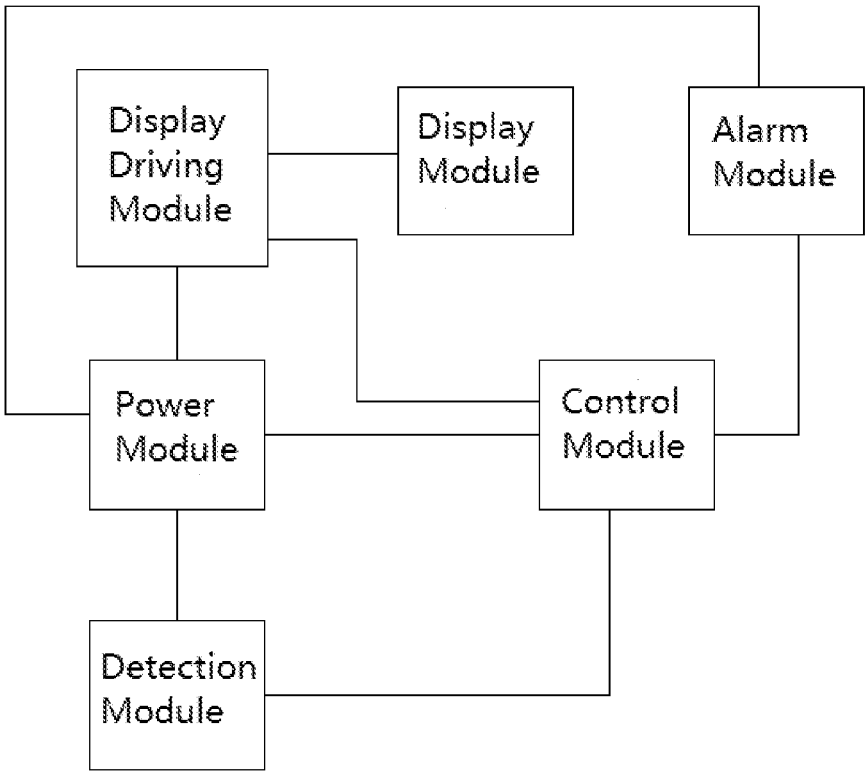
FIG. 1 is a block diagram of a safety device of a winch according to the invention.
Figure 2:
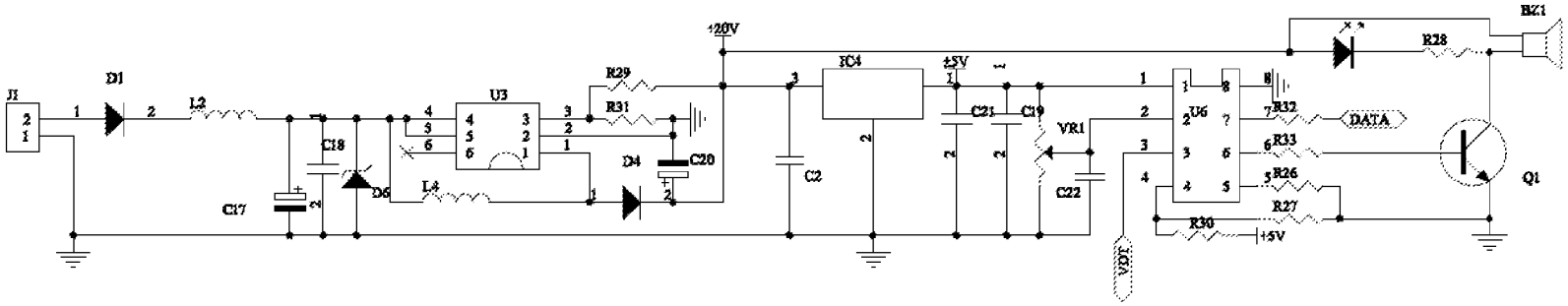
FIG. 2 is a circuit schematic diagram of a first part of a safety device of a winch according to the invention.

As shown in FIG. 2, the first part includes a power module, a control module, an adjusting module and an alarm module. The control module is mainly composed of a single-chip microcomputer U6. The switching unit is composed of resistor R30 and resistor R27. One end of resistor R30 may be vacant or electrically connected to the power supply end of the power module. The power supply end, for example, the second voltage reduction and voltage stabilization unit, is capable of supplying a power supply voltage of 5V. The other end of resistor R30 is electrically connected to one end of resistor R27 to form a common end, and the common terminal is electrically connected to pin 4 of single-chip microcomputer U6. The other end of resistor R27 is grounded. The pin 4 is controlled by vacating or adding a voltage to one end of resistor R27, so that the function of switching is realized. The adjusting module is mainly composed of adjustable resistor VR1, which is adjusted to change the level of pin 2 of single-chip microcomputer U6, so that an alarm threshold value of the control module is set. The alarm module is mainly composed of a light emitting diode, loudspeaker BZ1 and transistor Q1. The alarm module can give a sound and light alarm. The second voltage reducing and stabilizing unit is mainly composed of three-terminal integrated voltage stabilizer IC4. The second voltage reducing and stabilizing unit can supply a power supply voltage of 5V. The boosting unit is mainly composed of boost converter U3 and is used to raise the power supply voltage of the front end to 20V. In order to obtain a better power supply quality, the power supply module further includes an anti-reversal unit, a filtering unit and an anti-impact unit. The anti-reversal unit is mainly realized by diode D1, the filtering unit is mainly realized by capacitor C17, and the anti-impact unit is mainly realized by diode D6.

Figure 5:
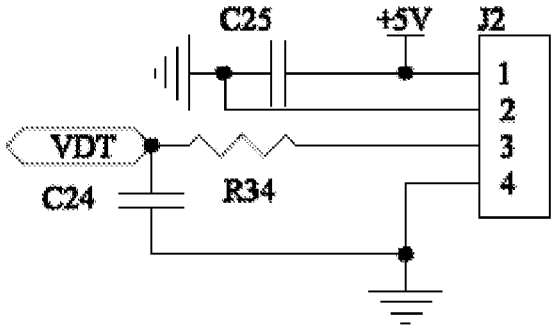
FIG. 5 is a circuit schematic diagram of a detection module of a safety device of a winch according to the invention.
Figure 6:
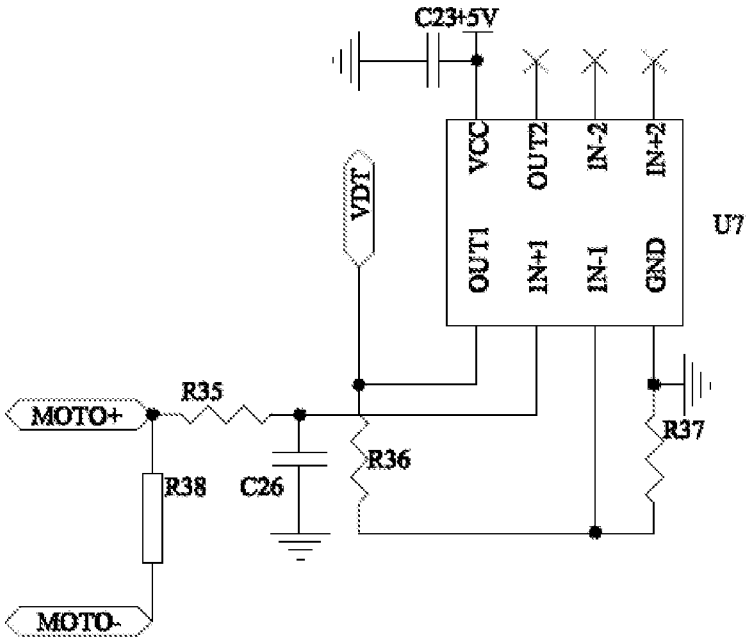
FIG. 6 is another circuit schematic diagram of a detection module of a safety device of a winch according to the invention.
Figure 7:
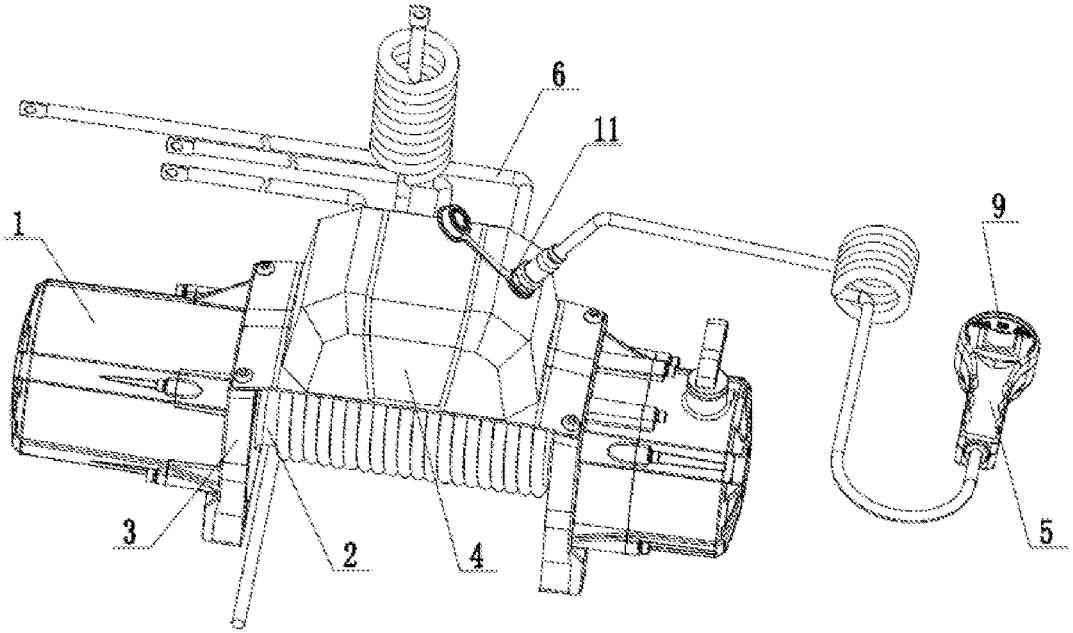
FIG. 7 is a schematic structural diagram of a winch according to the invention.
Figure 8:
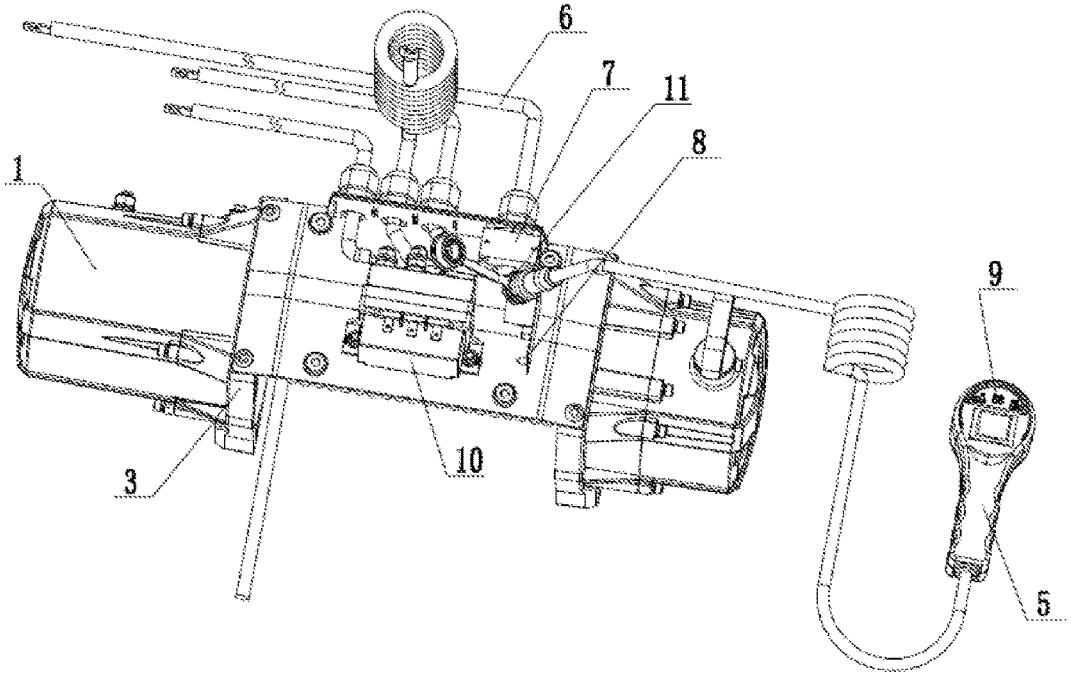
FIG. 8 is another schematic structural diagram of a winch according to the invention.

The first part may be manufactured on a circuit board, which is called a first circuit board. In this embodiment, the detection module is mainly composed of a hall current sensor. The first circuit board is provided with an interface electrically connected to the hall current sensor, and the circuit principle diagram of the interface is shown in FIG. 5. In FIG. 5, the signal obtained by the interface is transmitted to pin 3 of single chip microcomputer U6. Alternatively, the detection module may also be composed of other structures. For instance, as shown in FIG. 6, the detection module is provided on the basis of resistor R38 and the resistance type detection module is formed around resistor R38.

Figure 3:
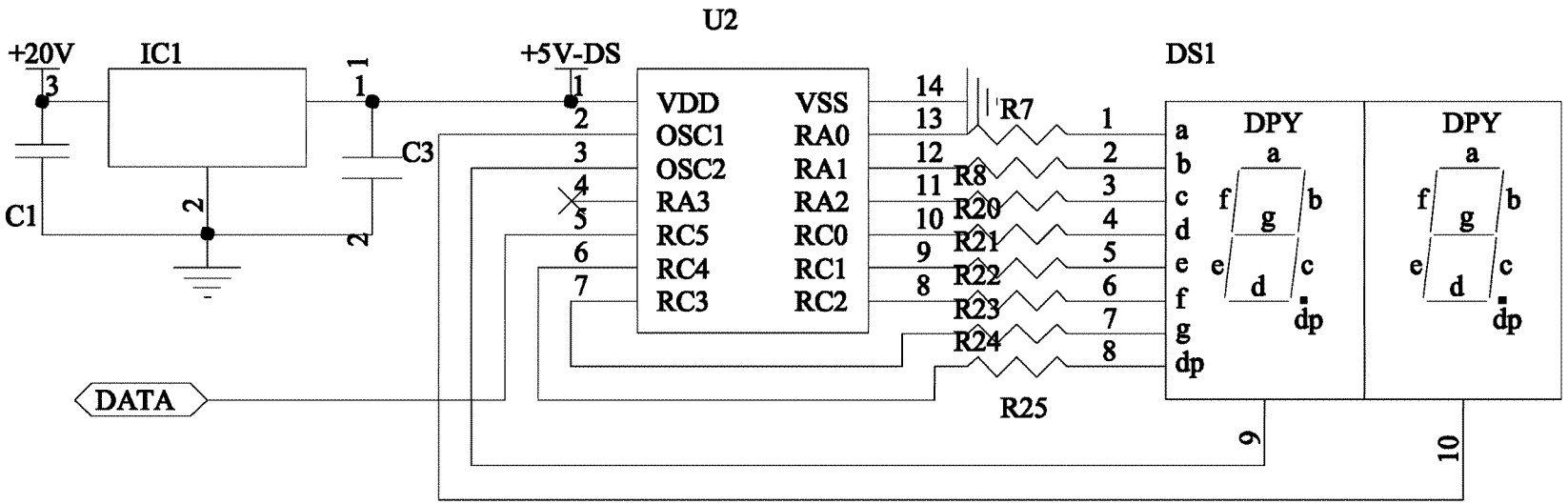
FIG. 3 is a circuit schematic diagram of a second part of a safety device of a winch according to the invention.

One embodiment of the second part is shown in FIG. 3 and includes a first voltage reducing and stabilizing unit, a display driving module and a display module. The first voltage reducing and stabilizing unit is composed of a three-end integrated voltage stabilizer IC1 and may supply a power supply voltage of 5V. The display driving module is mainly composed of driver U2 and is used to drive the display module to display according to a digital signal output from pin 7 of single chip microcomputer U6. The display module is composed of two eight-bit nixie tubes and thus has features of a low energy consumption, a low delay, stability and reliability.

Figure 4:
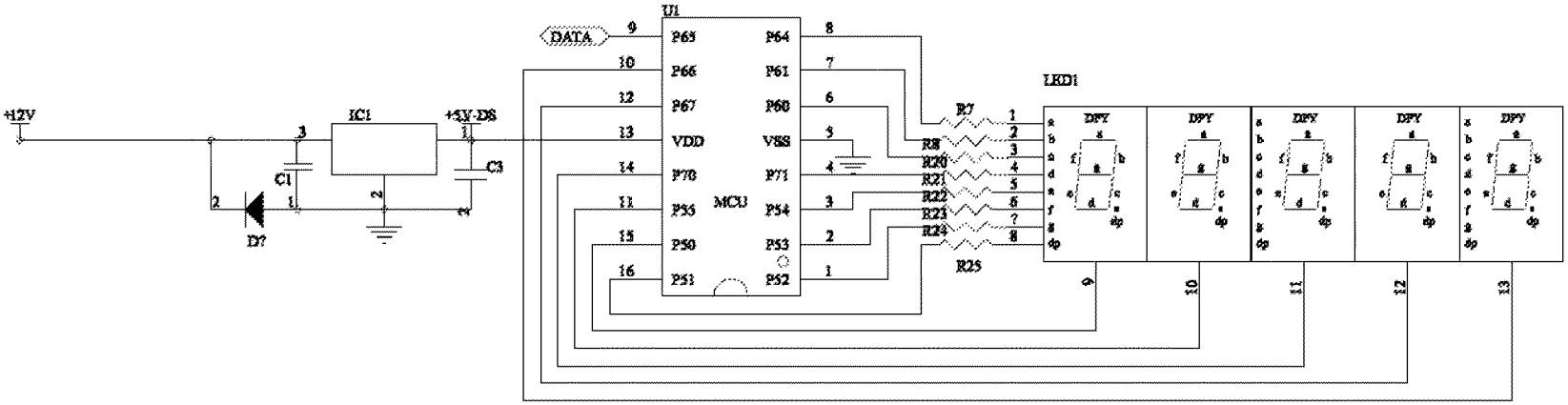
FIG. 4 is another circuit schematic diagram of a second part of a safety device of a winch according to the invention.

Another embodiment of the second part is shown in FIG. 4, and the main differences between this embodiment and the second part shown in FIG. 3 are provided as below. The input end of the first voltage reducing and stabilizing unit is connected to the storage battery, which supplies a voltage of 12V to the input end. The voltage of 12V is then reduced through the first voltage reducing and stabilizing unit, so that a power supply voltage of 5V is supplied. In this way, it is unnecessary to arrange a separate power line to the control handle, because the existing power line in the control handle in the prior art may be shared as the power line connected to the input end of the first voltage reducing and stabilizing unit. Furthermore, a second part of FIG. 4 is provided with diode D7 to prevent impacts, and diode D7 plays a role in impact resistance.

Further, the display module may have multiple bits, for instance, the display module in FIG. 4 is composed of five eight-bit nixie tubes, so that more bits of data are expressed. Accordingly, the display driving module provides a driver capable of driving the five eight-digit nixie tubes.

The second part may be manufactured on a circuit board, which is called as a second circuit board. The second circuit board is arranged at a control handle of the winch.

The control module converts a signal detected by the detection module into a control signal, and the conversion may be realized by looking up a two-dimensional table. The two-dimensional table obtains load values or pull force values corresponding to the signals detected by the detection module under different loads through a test. The load value or the pull force value may be set as codes. In this way, the signal values detected by the detection module are set as one dimension while the codes are set as the other dimension, so as to form a two-dimensional table, which is then stored in the control module. According to the signal values detected by the detection module, the control module can obtain corresponding codes by looking up the two-dimensional table. The display driving module stores display values corresponding to the codes. If the codes are sent to the display driving module, the display driving module drives the display module to display corresponding display values, and the display values represent load values or pull force values. Alternatively, other conversion modes may be adopted herein, such as calculation through formulas. But in general, the conversion mode of looking up the two-dimensional table requires low operation and storage capacities of the control module, and has a fast response, and thus has an advantage of a high real-time capability.

Embodiment 2

A winch of the present invention includes motor 1, winch drum 2, and bracket 3. Motor 1 and winch drum 2 are both connected to bracket 3. Motor 1 is used for driving winch drum 2 to rotate. The winch further includes a detection device and an expression device. The detection device is used for detecting the working load of motor 1. The expression device is used for expressing the load according to the detection signal of the detection device.

The detection device adopts a shunt resistor for current-shunting and sampling, so as to monitor the working current of the motor. For example, the current obtained through shunt resistor R38 in FIG. 6 changes along with the load change of the motor 1. If the expression device adopts a bulb, the current obtained through shunt resistor R38 is loaded on the bulb, the brightness of the bulb changes along with the current. In this way, the brightness and darkness changes of the bulb form an expression of the load, so as to provide a reference of the load change for the user.

Embodiment 3

A winch of the present invention adopts the safety device of the winch of Embodiment 1.

A winch of the present invention includes motor 1, winch drum 2, and bracket 3. Motor 1 and winch drum 2 are both connected to bracket 3. Motor 1 is used for driving winch drum 2 to rotate. The winch further includes a detection device and an expression device. The detection device is used for detecting the working load of motor 1. The expression device is used for expressing the load according to the detection signal of the detection device.

The winch further includes a power module, and the expression device includes a control module, a display driving module and display module 9. The display driving module is electrically connected to display module 9. The display driving module and the detection device are respectively electrically connected to the power module. The power module, the detection device and the display driving module are respectively electrically connected to the control module. The control module is used for converting the signals detected by the detection module into control signals, which are used to control the display driving module to drive display module 9 to display.

The winch further includes an alarm module, and the power module and the control module are respectively electrically connected to the alarm module.

The power module includes a voltage boosting unit, a first voltage reducing and stabilizing unit, and a second voltage reducing and stabilizing unit. The first voltage reducing and stabilizing unit, and the second voltage reducing and stabilizing unit are respectively electrically connected to the voltage boosting unit. The first voltage reducing and stabilizing unit is electrically connected to the display driving module. The detection module, and the control module are respectively electrically connected to the second voltage reducing and stabilizing unit.

The first voltage reducing and stabilizing unit, the display drive module, and display module 9 are all arranged at control handle 5 of the winch.

The expression device includes first circuit board 8 and a second circuit board, first circuit board 8 is arranged in control box 4 of the winch, and the second circuit board is arranged at the control handle of the winch. First circuit board 8 is provided with a voltage boosting unit, a second voltage reducing and stabilizing unit, and a control module. The second circuit board is provided with a first voltage reducing and stabilizing unit, a display driving module, and display module 9.

The electrical signals between control handle 5 and control box 4 are transmitted through cables. Control box 4 is provided with connector 11, and contactor 10 is arranged in control box 4. The input end of contactor 10 is connected to a power supply, such as a storage battery. The output end of contactor 10 is connected to motor 1, and control handle 5 makes motor 1 stop, rotate forwards or rotate reversely through a control contactor.

The power supply module gets electricity from a power supply, the input end of contactor 10 or the output end of contactor 10.

The winch further includes an adjusting module, which is used for setting an alarm threshold value of the control module.

The control module is provided with a switching unit, which is used for the control module to selectively switch between two states.

The structures of first circuit board 8 and the second circuit board are the same as that of Embodiment 1.

In this embodiment, the detection module is mainly composed of hall current sensor 7, which is arranged around power supply line 6 in a sleeved mode, wherein power supply line 6 is used for transmitting power to motor 1. Hall current sensor 7 is also located in control box 4. Hence, hall current sensor 7 is well protected, and the heat is easily dissipated. The first circuit board is provided with an interface electrically connected to the hall current sensor, and the circuit principle diagram of the interface is shown in FIG. 5. In FIG. 5, the signal obtained by the interface is transmitted to pin 3 of single chip microcomputer U6. Alternatively, the detection module may also be composed of other structures. For instance, as shown in FIG. 6, the detection module is provided on the basis of resistor R38 and the resistance type detection module is formed by resistor R38 and the components around resistor R38.

The control module converts a signal detected by the detection device into a control signal, and the conversion mode is the same as that of Embodiment 1.

The above description is only related to preferred embodiments of the present invention, therefore, equivalent changes or modifications made to the structures, features and principles within the scope of the present invention, all fall into the scope of the present invention.

What is claimed is:

1. A safety device of a winch, comprising:

a power module;

a detection module;

a control module;

a display driving module; and a display module;

wherein the display driving module is electrically connected to the display module; the display driving module and the detection module are electrically connected to the power module; the power module, the detection module and the display driving module are electrically connected to the control module;

wherein the control module is configured to convert a signal detected by the detection module into a control signal, and the control signal controls the display driving module to drive the display module to display;

wherein the power module includes a voltage boosting unit, a first voltage reducing and stabilizing unit, and a second voltage reducing and stabilizing unit, wherein the first voltage reducing and stabilizing unit and the second voltage reducing and stabilizing unit are electrically connected to the voltage boosting unit, the first voltage reducing and stabilizing unit is electrically connected to the display driving module, the detection module and the control module are electrically connected to the second voltage reducing and stabilizing unit.

2. The safety device of a winch of claim 1, wherein the safety device further includes an alarm module, and the power module and the control module are electrically connected to the alarm module.

3. The safety device of a winch of claim 1, wherein the first voltage reducing and stabilizing unit, the display driving module and the display module are all arranged at a control handle of the winch.

4. The safety device of a winch of claim 1, wherein the safety device further includes an adjusting module, and the adjusting module is configured for setting an alarm threshold value of the control module.

5. The safety device of a winch of claim 1, wherein the control module is provided with a switching unit, and the switching unit is configured to selectively switch between two states.

6. A winch, comprising:

a motor;

a winch drum;

a bracket;

a detection device; and an expression device, wherein the motor and the winch drum are both connected to the bracket, and the motor is configured to drive the winch drum to rotate, wherein the detection device is configured to detect a working load of the motor, and the expression device is configured to display the working load according to a detection signal of the detection device;

wherein the winch further includes a power module, wherein the expression device includes a control module, a display driving module and a display module, wherein the display driving module is electrically connected to the display module, the display driving module and the detection device are respectively electrically connected to the power module, and the power module, the detection device and the display driving module are respectively electrically connected to the control module, wherein the control module is configured to convert a signal detected by the detection module into a control signal, and the control signal controls the display driving module to drive the display module to display;

wherein the expression device includes a first circuit board and a second circuit board, the first circuit board is arranged in a control box of the winch, and the second circuit board is arranged at a control handle of the winch, wherein the first circuit board is provided with a voltage boosting unit, a second voltage reducing and stabilizing unit and the control module, and the second circuit board is provided with a first voltage reducing and stabilizing unit, the display driving module and the display module.

* * * * *